US006736473B2

(12) United States Patent
Cleveland et al.

(10) Patent No.: US 6,736,473 B2
(45) Date of Patent: May 18, 2004

(54) FIRE-RESISTANT CABINET

(75) Inventors: Terri Peartree Cleveland, Holley, NY (US); Kelvin H. Wildman, Honeoye Falls, NY (US); R. David Pallo, Fairport, NY (US); Richard James Rhinewald, Macedon, NY (US); Douglas Owen Nichol, Walworth, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 48 days.

(21) Appl. No.: 09/993,950

(22) Filed: Nov. 16, 2001

(65) Prior Publication Data

US 2003/0094885 A1 May 22, 2003

(51) Int. Cl.[7] ..... A47B 96/04
(52) U.S. Cl. ..... 312/409; 109/80
(58) Field of Search ..... 312/409, 400, 312/410, 223.1; 109/49.5, 80, 81, 82, 83, 84; 52/232, 309.9, 784.11, 794.11

(56) References Cited

U.S. PATENT DOCUMENTS

| | | | | | |
|---|---|---|---|---|---|
| 1,547,721 | A | | 7/1925 | Bellamore | |
| 2,492,422 | A | | 12/1949 | Govan | |
| 2,554,399 | A | | 5/1951 | Bremer | |
| 3,559,594 | A | | 2/1971 | Miller et al. | |
| 3,762,787 | A | * | 10/1973 | Grubb | 312/409 |
| 4,108,087 | A | * | 8/1978 | Sebesta | 109/84 |
| 4,574,454 | A | * | 3/1986 | Dyson | 109/84 |
| 4,616,694 | A | * | 10/1986 | Hsieh | 165/47 |
| 4,632,865 | A | | 12/1986 | Tzur | |
| 4,685,402 | A | | 8/1987 | Nelson et al. | |
| 4,735,155 | A | * | 4/1988 | Johnson | 109/80 |
| 4,814,217 | A | * | 3/1989 | Kallstrom | 428/920 |
| 4,893,397 | A | * | 1/1990 | Hughes | 312/409 |
| 5,060,582 | A | * | 10/1991 | Salzer | 109/82 |
| 5,481,834 | A | * | 1/1996 | Kowalczyk et al. | 52/64 |
| 5,945,208 | A | * | 8/1999 | Richards et al. | 428/920 |
| 6,114,003 | A | * | 9/2000 | Gottfried | 428/920 |
| 6,158,833 | A | * | 12/2000 | Engler | 312/409 |

FOREIGN PATENT DOCUMENTS

| | | | |
|---|---|---|---|
| GB | 9309942.2 | | 11/1994 |
| GB | 2293208 | * | 3/1996 |
| JP | 07042344 | * | 2/1995 |
| WO | 9105128 | * | 4/1991 |

* cited by examiner

*Primary Examiner*—Lanna Mai
*Assistant Examiner*—Hanh V. Tran
(74) *Attorney, Agent, or Firm*—Jaeckle Fleischmann & Mugel, LLP

(57) ABSTRACT

A fire-resistant container for use as a safe, formed of steel and lined on its inner surface with a composition comprising insulative and intumescent materials, preferably mineral wool insulation and hydrated sodium silicate fiberboard, respectively. Preferably, an air space is also provided between the fire-resistant materials and the wall. A hinged door of the container is fitted with fire-resistant materials in similar fashion to the container walls, and the door's jamb is gasketed in intumescent material. Within the container, an inner wall is formed of a fire-resistant material such as gypsum board. The aforementioned fire-resistant container meets Underwriters Laboratories Standard 72 and is suitable for storage of paper documents, firearms, and other valuables.

13 Claims, 7 Drawing Sheets

FIRE-RESISTANT CABINET

TECHNICAL FIELD

The present invention relates to fire-resistant containers; more particularly, to fire-resistant safes; and most particularly, to a fire-resistant safe comprising both insulative and intumescent materials.

BACKGROUND OF THE INVENTION

Containers for temporarily protecting their contents from damage from external heat sources such as fire are well known. Such containers are said in the art to be "fire-resistant" and typically are rated for integrity over a specific exposure temperature and/or time. Lockable fire-resistant containers are known as fire-resistant "safes" and are widely used for storage of documents, firearms, or other valuables which may be damaged or destroyed by exposure to high temperatures. For example, various models of fire-resistant safes are available from Sentry Group, Rochester, N.Y. 14625 USA.

A common problem encountered in some inexpensive prior art so-called fire-resistant safes is that they may include some fire-resistant or fire-rated materials such as gypsum board or drywall, but they do not pass the stringent explosion and fire endurance tests found in Underwriters Laboratories Standard 72, parts 1 and 2. Part 1 requires a container to maintain an internal temperature of less than 350° F. while the container is thermally ramped up a prescribed time-temperature curve from room temperature to 1550° F. over 30 minutes. Part 2 requires a container to protect paper from decomposing or igniting in a simulated explosion condition of instantaneous external temperature of 2000° F. for 20 minutes.

One approach to meeting these requirements in the prior art is to provide a container having relatively thick walls and large mass. Such a safe is expensive to manufacture, costly to purchase, and cumbersome to transport.

What is needed is a fire-resistant safe which is inexpensive to manufacture, easy to transport, and meets the requirements of Underwriters Laboratories Standard 72.

It is the primary object of the invention to provide an improved fire-resistant safe for storage of documents, firearms, or other valuables which is inexpensive to manufacture, easy to transport, and meets the requirements of Underwriters Laboratories Standard 72.

SUMMARY OF THE INVENTION

The invention is directed to a fire-resistant container for use as a safe. The container is formed of steel and is lined on its inner surface with fire-resistant materials. The preferred fire-resistant materials include both mineral wool insulation, to retard the passage of heat into the interior of the container, and hydrated fiberboard to swell and thereby seal the container while undergoing progressive dehydration and intumescence. Preferably, an air space is also provided between the fire-resistant materials and the wall. A front wall of the container is formed with an offset jamb for receiving a safe door having a conventional combination lock controlling a plurality of livebolts which are received in bolt cups formed in the jamb. The door is fitted with fire-resistant materials in similar fashion to the container walls, and the jamb is gasketed in intumescent material. Within the container, an inner wall is formed of a fire-resistant material such as gypsum board. A fire-resistant container in accordance with the invention meets Underwriters Laboratories Standard 72 and is suitable for storage of paper documents, firearms, and other valuables.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings, in which.

DESCRIPTION OF THE PREFERRED EMBODIMENT

Figure 1:
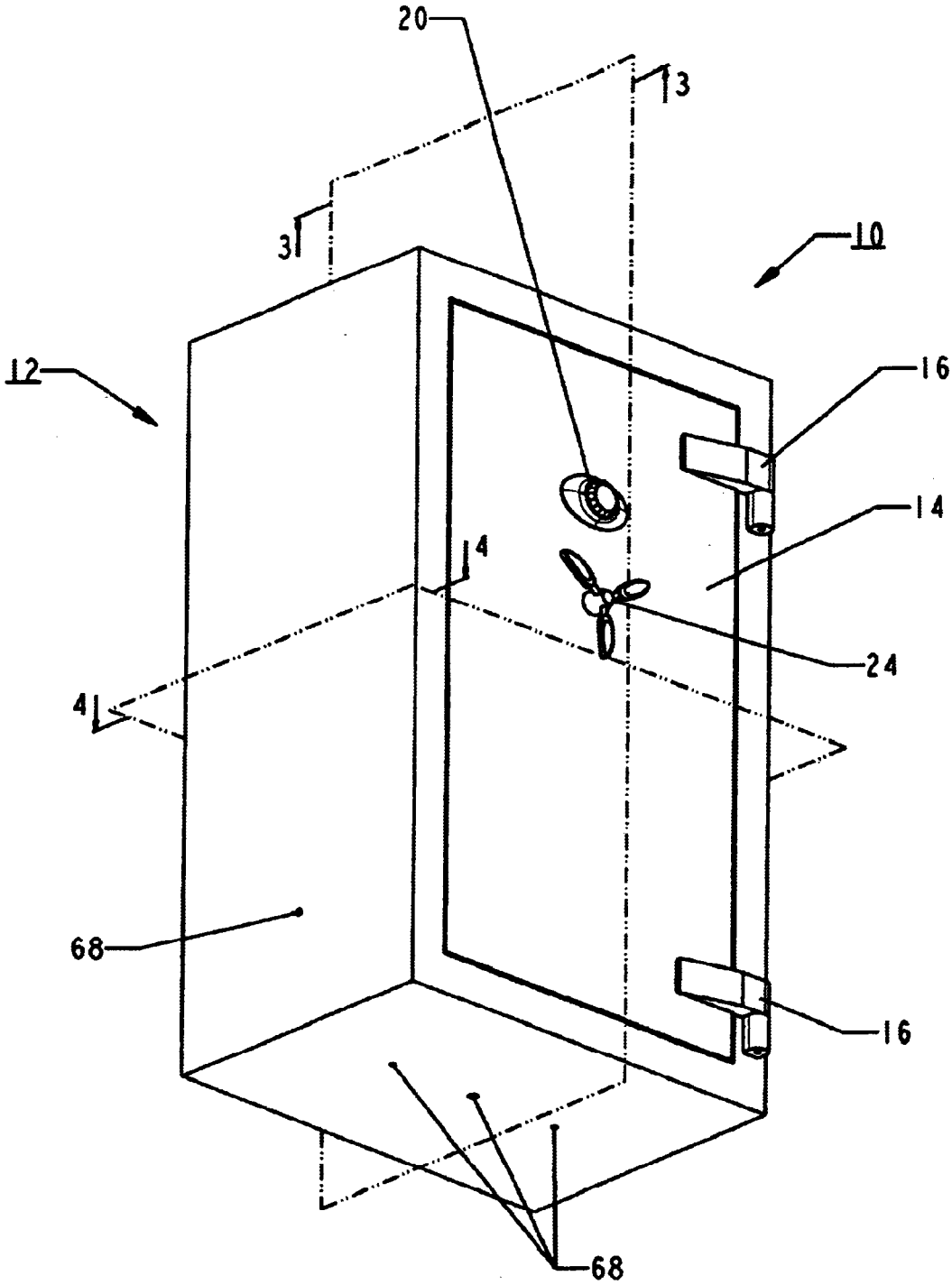
FIG. 1 is an isometric view from below of a fire-resistant container in accordance with the invention, showing the general appearance and the locations of vent holes in the container bottom and left side.
Figure 2:
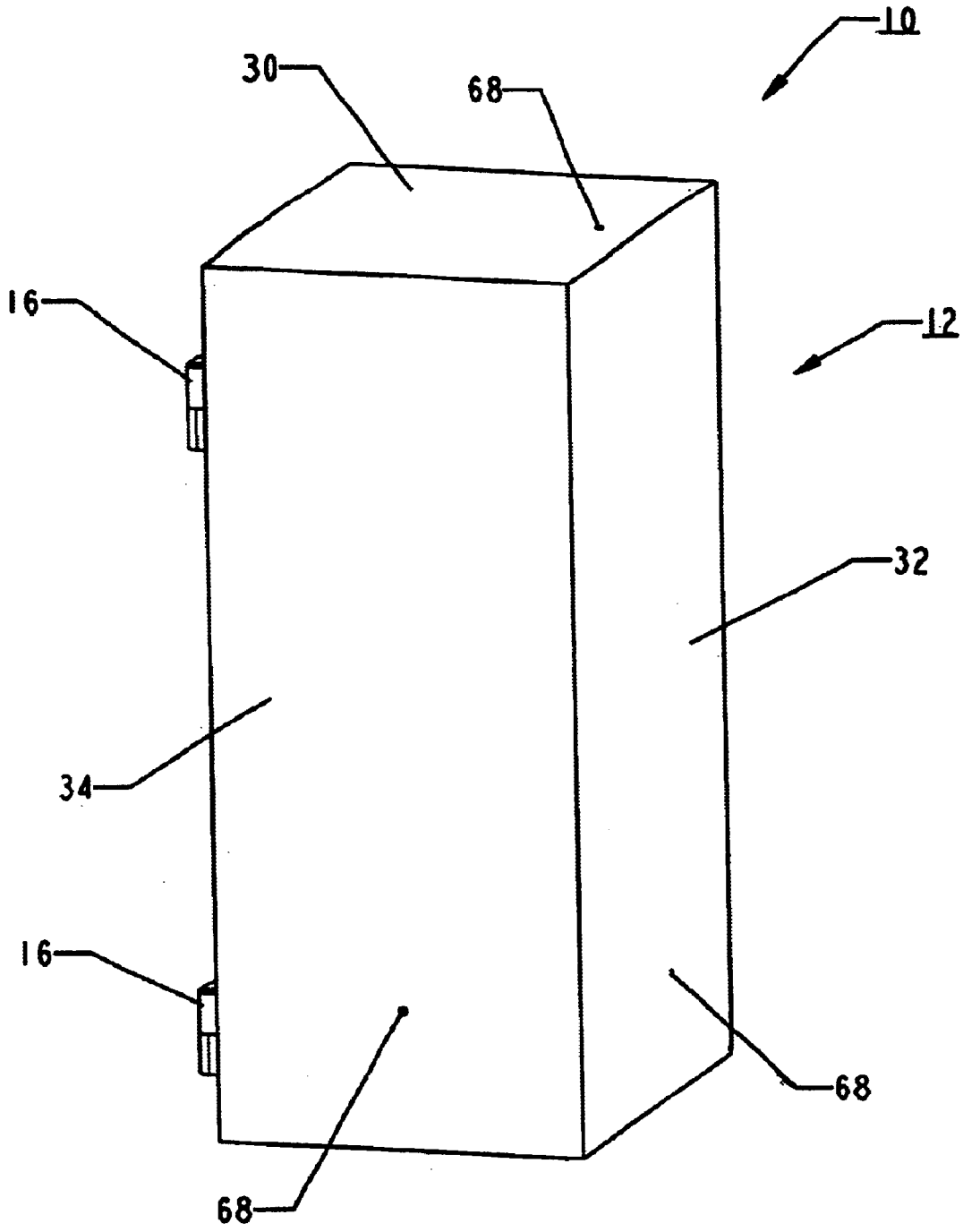
FIG. 2 is an isometric view from the right side and rear of the container shown in FIG. 1, showing the locations of vent holes in the container top, right side, and back.
Figure 3:
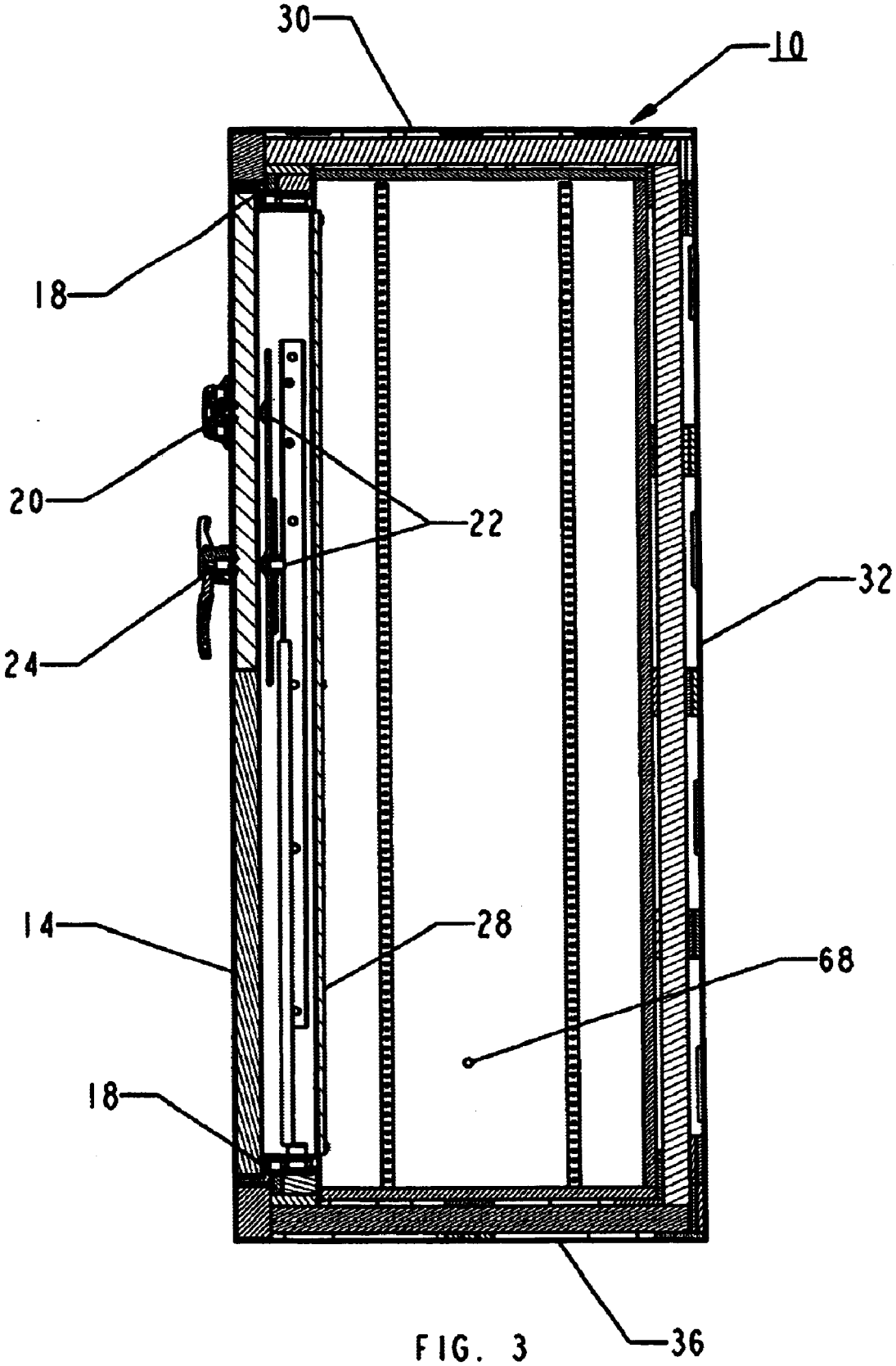
FIG. 3 is an elevational cross-sectional view of a section formed by plane 3—3 in FIG. 1.
Figure 4:
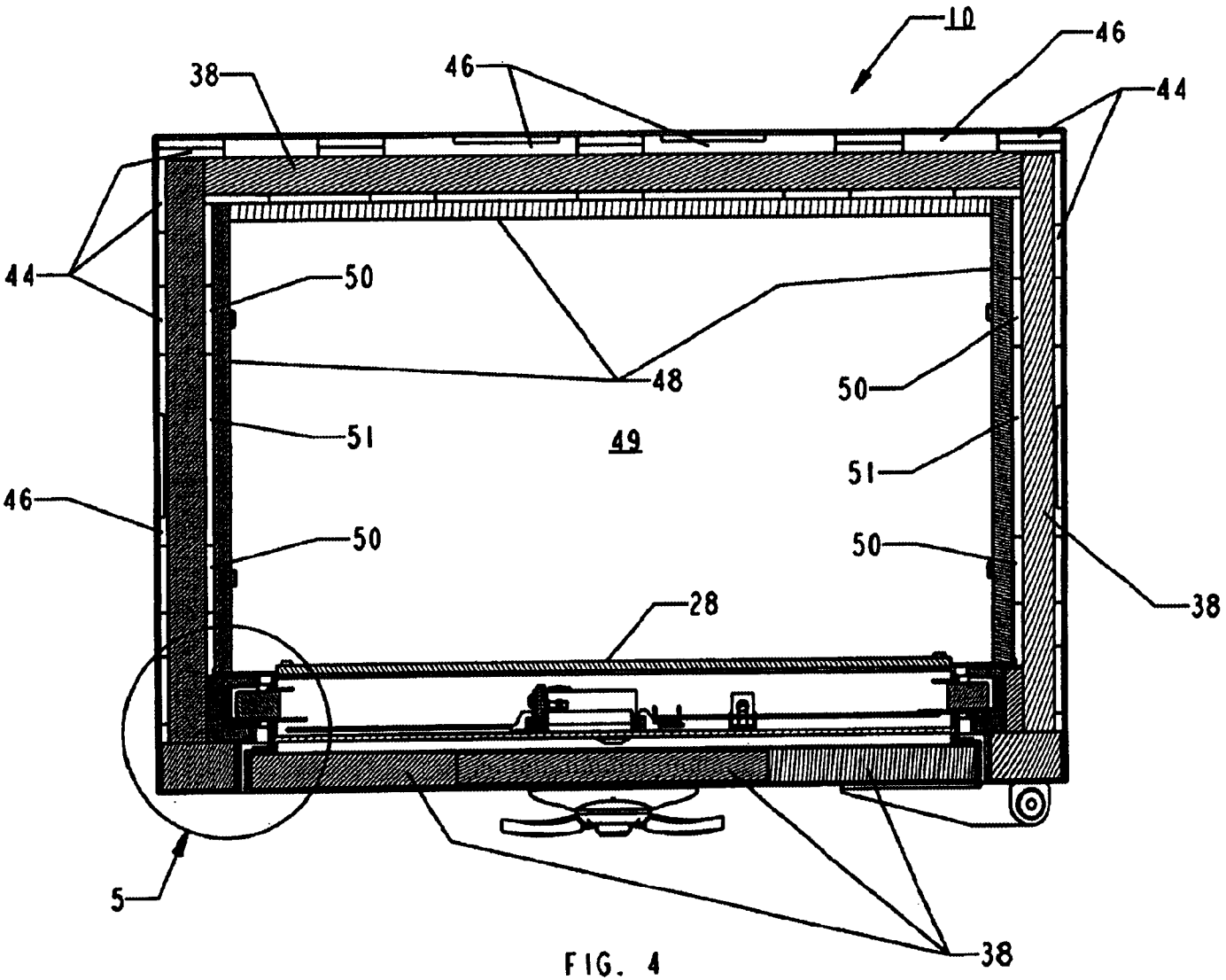
FIG. 4 is an equatorial cross-sectional view of a section formed by plane 4—4 in FIG. 1.
Figure 5:
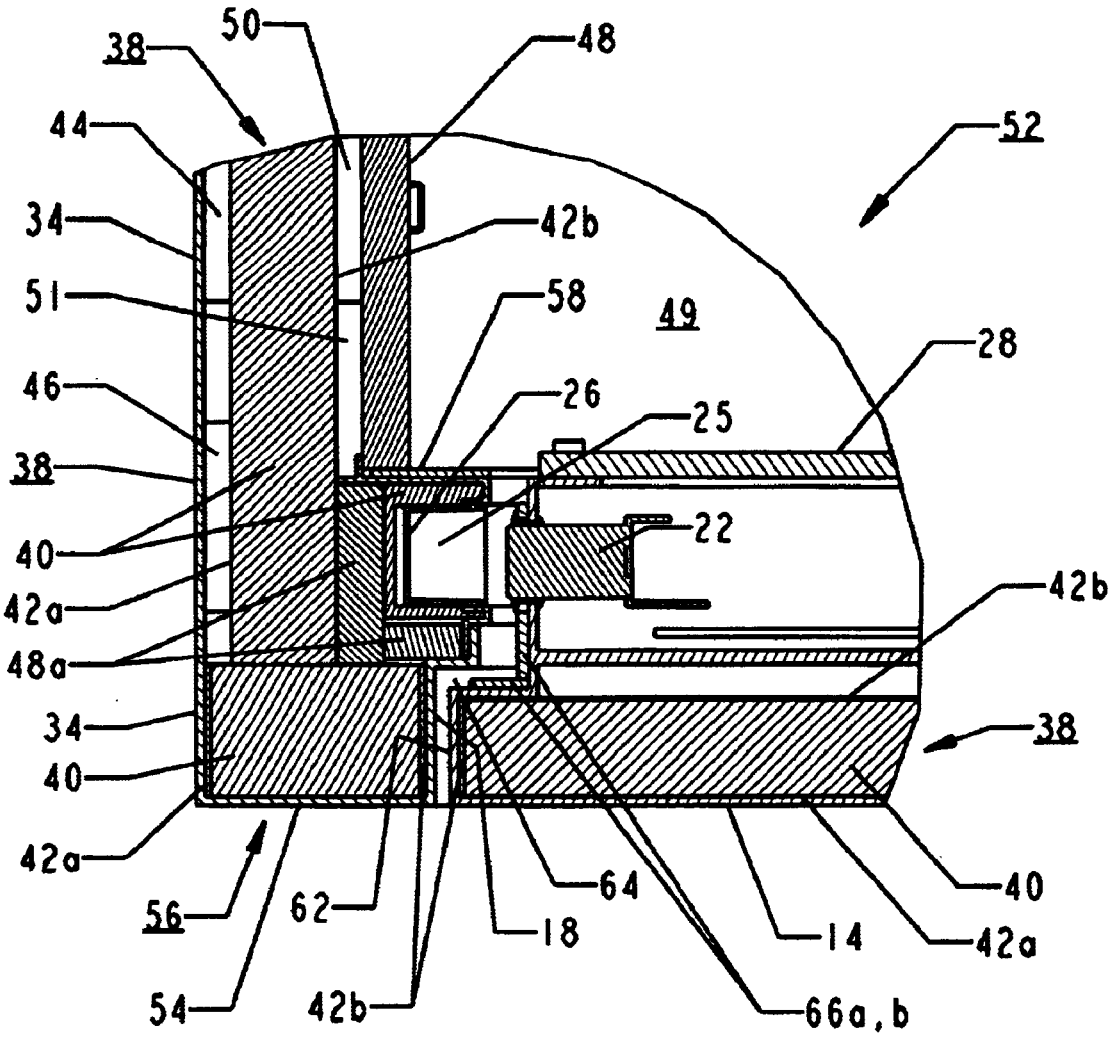
FIG. 5 is a detailed view of the jamb and door arrangement shown in circle 5 in FIG. 4

Referring to FIGS. 1 through 3, a fire-resistant container 10 in accordance with the invention comprises a rectilinear box 12 closed by a door 14 pivotably attached to box 12 by external hinges 16. Box 12 defines an outer wall of the container and is preferably formed of sheet steel, preferably about 3 mm thick. Door 14 is also preferably formed of sheet steel about 3 mm thick. Door 14 is received in an offset jamb 18 formed around the opening of box 12, the jamb being offset to prevent direct ingress of implements to the interior of the box. Door 14 is provided with a conventional combination lock 20 operationally connected to a conventional livebolt array 22 controlled by a central handle 24. Upon rotation of handle 24, livebolts 22 are received conventionally in, or withdrawn from, a plurality of pockets 25 formed by bolt cups 26 recessed at intervals around jamb 18 (FIGS. 4 and 5). Door 14 is provided with an inner cover 28 for covering the locking and livebolt mechanisms.

Referring to FIGS. 3 through 5, box 12 comprises a top wall 30, back wall 32, side walls 34, and bottom 36. All walls and the door are lined along their inner surfaces with a fire-resistant composition 38 comprising a core portion 40 of an insulative mineral wool, for example, Termika BSI, available from ODICE S.A. Fire Protection, Marly, France, and a surface portion 42 of a hydrated intumescent material, for example, PALUSOL Fire Board, available from BASF A. G., Ludwigshafen, Germany. The intumescent material is provided on at least one surface of the mineral wool, for example, the outer surface thereof, and preferably on both surfaces, as shown in FIG. 5. Preferably, the intumescent material is laminated to the mineral wool. Preferably, cut edges of the laminated material are also secondarily covered with intumescent material such that the mineral wool is nowhere exposed directly to heat. Preferably, the fire-resistant composition 38 is off-spaced from the inner surfaces of the walls by incombustible spacers 44 formed of, for example, 9 mm magnesium oxide board, to provide a first insulative air space 46 therebetween. Preferably, an 18 mm thick first air space is provided along the back 32. Inner walls 48 of container 10 are formed of fire-resistant sheet material, preferably gypsum-core sheetrock or wallboard. Preferably, inner walls 48 are also off-spaced from fire-resistant composition 38 by incombustible spacers 50 to provide an additional second insulative air space 51 therebetween.

Referring to FIG. 5, a currently preferred configuration 52 is shown in the jamb region of the container. Side wall 34, front wall 54, and jamb 18 cooperate to form a structural cove 56 that frames the doorway. Cove 56 is filled with composition 38 having intumescent material 42*a,b* on all four surfaces. Supported and retained by jamb 18 is an inner jamb extrusion 58 and bolt cup 26 for receiving livebolt 22 as described above. The jamb extrusion is also filled with composition 38 and sheetrock 48*a*. Door 14 is insulated similarly to the walls; however, inner cover 28 preferably is formed of magnesium oxide board similar to the material employed in spacers 44,50. Door 14 is further provided with an edge 62 formed to conform with jamb 18 which defines a labyrinthine space 64 therebetween. Door gaskets 66*a*, 66*b* surrounding the entire edge of door 14 are formed preferably of a sodium silicate intumescent material, for example, PALUSOL P or PALUSOL PM, available from ODICE S.A. Fire Protection. This material can expand, upon dehydration by heat, to at least five times its original thickness, rapidly filling space 64 with a rigid, non-combustible foam with a high level of thermal insulation and thereafter preventing ingress of flame and smoke into box 12.

The intumescent material gives off significant amounts of water vapor or steam during intumescence which requires venting to the exterior of the box. Therefore, a plurality of vent holes 68, as shown in FIGS. 1–3 are provided, extending from the exterior of the box through various walls into first air spaces 46. Preferably, each vent hole is about 7/16-inch in diameter. In addition, at least one vent hole, and preferably a hole formed in bottom 36, extends completely through all interior materials to box interior 49 and may be lined with a ceramic tube to prevent plugging. Preferably, each vent hole 68 is provided with a patch of mineral wool material, for example, SUPERWOOL Blanket X607, available from ODICE S.A. Fire Protection, applied to the inner surface of the walls of the cabinet adjacent to and around the vent hole such that venting is assured despite thermal deformation and expansion of the adjacent intumescent material.

In operation, when container 10 is exposed to high external temperature, heat conducted through the walls of box 12 is initially absorbed in the latent heat of vaporization of water in outer surface portion 42*a* of fire-resistant composition 38. Transmission of heat is retarded by air space 46. Heat transmitted through portion 42*a* and core portion 40 is initially absorbed in the latent heat of vaporization of water in inner surface portion 42*b*. Transmission of heat beyond portion 42*b* is retarded by air space 51 and inner wall 48. Heat penetrating along labyrinthine space 64 is initially absorbed by intumescent gaskets 66*a,b* which rapidly swell to close space 64, thereby sealing completely the perimeter of door 14 against jamb 18.

Figure 6:
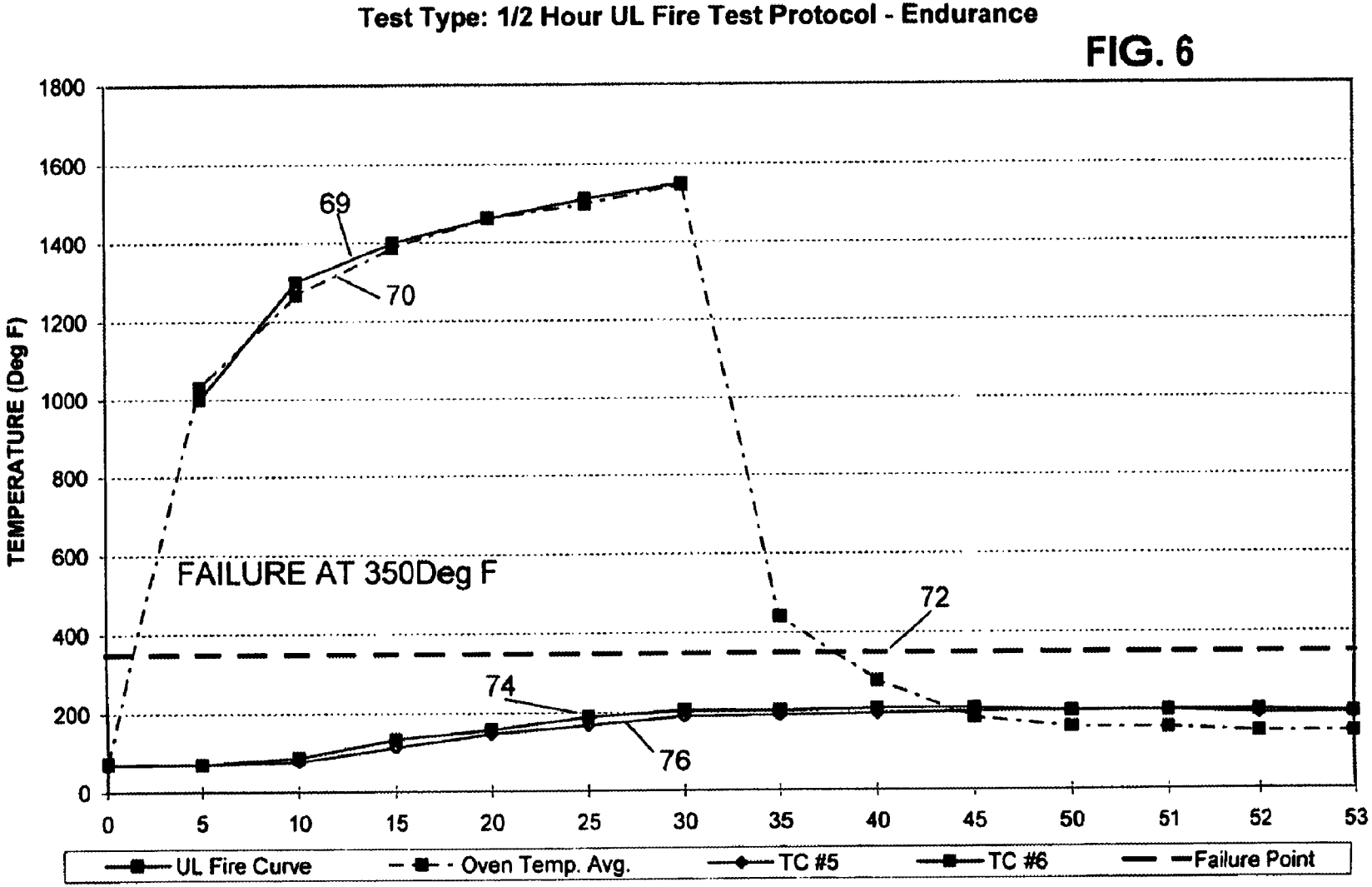
FIG. 6 is a graph showing change in temperature within the container during a fire-resistance test in a progressive fire in accordance with Underwriters Laboratories Standard 72.

FIG. 6 shows the fire-resistant benefit of a container in accordance with the invention. Curve 69 represents the Underwriters Laboratories temperature curve for onset of fire over a 30 minute interval, from room temperature to a terminal temperature of 1550° F. Curve 70 represents the measured temperatures of a test oven during an actual performance test. Curve 72 is the maximum temperature permissible (350° F.) within the container at any time during the test. Curves 74,76 are actual temperatures measured at two different locations within the container during the test. It is seen that the maximum temperature within the container did not exceed 200° F. during the 30 minutes of the test and increased only slightly during the cool-down phase thereafter. Thus, a margin of safety of more than 100 degrees was demonstrated.

Figure 7:
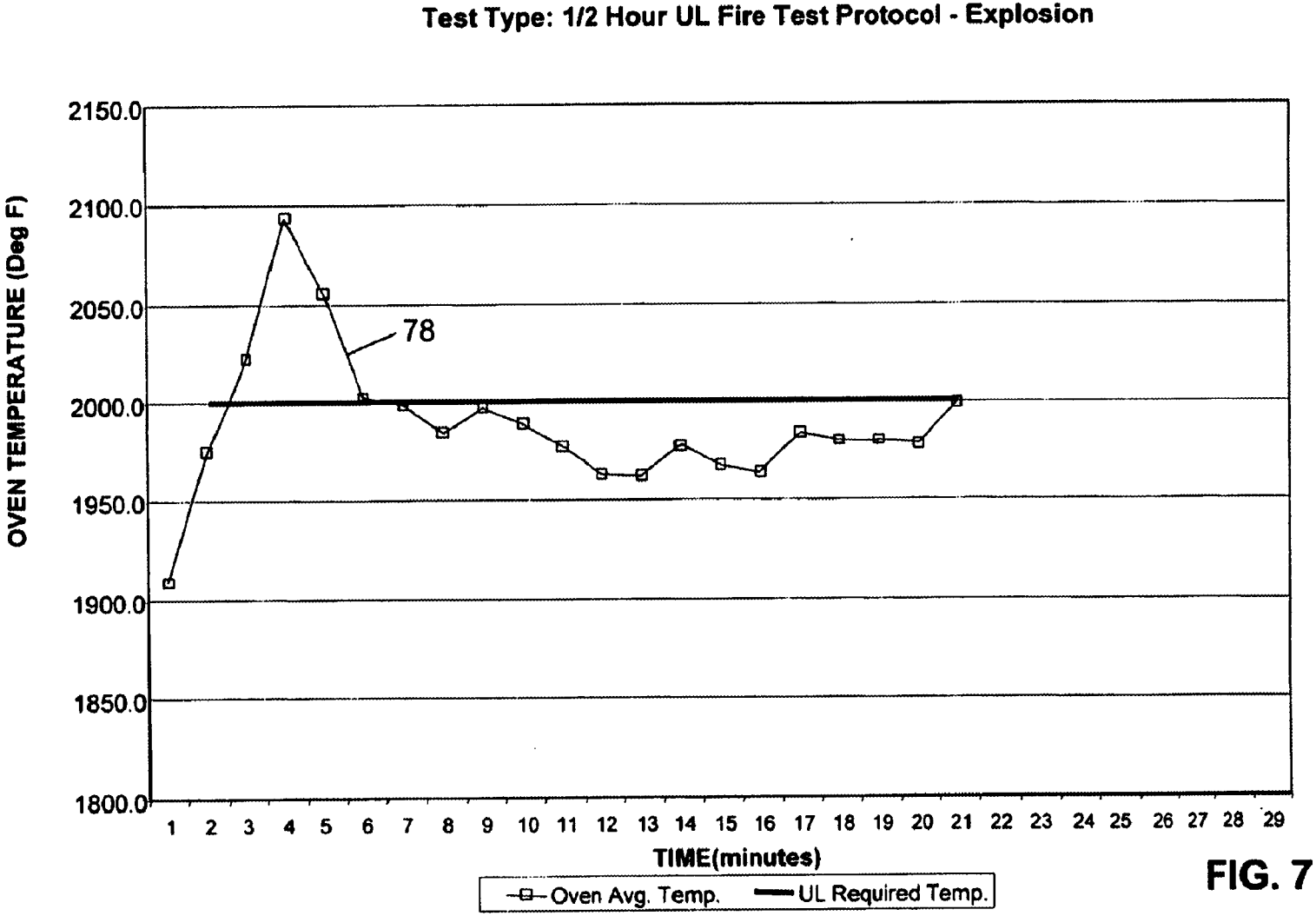
FIG. 7 is a graph showing change in temperature outside the container during a fire-resistance test in an explosive fire in accordance with Underwriters Laboratories Standard 72.

FIG. 7 shows measured temperatures 78 in an oven simulation of an explosive environment in accordance with Underwriters Laboratories Standard 72 (20 minutes, nominal temperature 2000° F.). Paper documents within a container in accordance with the invention survived this test.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A fire-resistant cabinet, comprising:

a) a rectilinear metal box having walls and having an opening in a wall thereof and a jamb surrounding said opening;

b) a metal door pivotably disposed by at least one hinge on said box for matably engaging said jamb for closure of said opening;

c) a locking mechanism for securing said door to said jamb;

d) insulative material disposed within said box along at least one of said walls;

e) intumescent material disposed within said box along at least one of said walls; and f) means for spacing said insulative and intumescent material from said walls to form a first insulative air space.

2. A cabinet in accordance with claim 1 further comprising insulative and intumescent material disposed within said box along said door.

3. A cabinet in accordance with claim 1 further comprising at least one inner wall within said box.

4. A cabinet in accordance with claim 3 wherein said inner wall comprises gypsum sheetrock.

5. A cabinet in accordance with claim 1 wherein said insulative material is mineral wool.

6. A cabinet in accordance with claim 1 wherein said intumescent material comprises hydrated sodium silicate.

7. A cabinet in accordance with claim 1 further comprising intumescent gasket material disposed along said door between said door and said jamb.

8. A cabinet in accordance with claim 7 wherein said insulative material, said intumescent material, and said gasket material are configured and disposed such that said cabinet meets Underwriters Laboratories Standard 72.

9. A cabinet in accordance with claim 1 wherein said intumescent material is disposed along a first side of said insulative material.

10. A cabinet in accordance with claim 1 wherein said intumescent material is laminated to said insulative material.

11. A fire-resistant cabinet, comprising:

a) a rectilinear metal box having walls and having an opening in a wall thereof and a jamb surrounding said opening;

b) a metal door pivotably disposed by at least one hinge on said box for matably engaging said jamb for closure of said opening;

c) a locking mechanism for securing said door to said jamb;

d) insulative material disposed within said box along at least one of said walls;

e) intumescent material disposed within said box along at least one of said walls; and f) means for spacing said insulative and intumescent material from said inner wall to form a second insulative air space.

12. A fire-resistant cabinet, comprising:

a) a rectilinear metal box having walls and having an opening in a wall thereof and a jamb surrounding said opening;

b) a metal door pivotably disposed by at least one hinge on said box for matably engaging said iamb for closure of said opening;

c) a locking mechanism for securing said door to said jamb;

d) insulative material disposed within said box along at least one of said walls; and e) intumescent material disposed within said box along at least one of said walls, wherein said intumescent material is disposed along first and second sides of said insulative material.

13. A fire-resistant cabinet, comprising:

a) a rectilinear metal box having walls and having an opening in a wall thereof and a jamb surrounding said opening;

b) a metal door pivotably disposed by a pair of hinges on said box for matably engaging said jamb for closure of said opening;

c) a locking mechanism for securing said door to said jamb;

d) insulative means disposed within said box along said walls and said door;

e) intumescent means disposed within said box along said walls and said door;

f) means for spacing said insulative and intumescent material from said walls to form a first insulative air space;

g) an inner wall within said box;

h) means for spacing said insulative and intumescent means from said inner wall to form a second insulative air space;

i) intumescent gasket means disposed along said door between said door and said jamb; and j) vent means extending through a wall of said box between the interior and the exterior of said cabinet.

* * * * *

UNITED STATES PATENT AND TRADEMARK OFFICE

CERTIFICATE OF CORRECTION

PATENT NO. : 6,736,473 B2
DATED : May 18, 2004
INVENTOR(S) : Terri P. Cleveland et al.

It is certified that error appears in the above-identified patent and that said Letters Patent is hereby corrected as shown below:

Column 5,
Line 27, replace "iamb" with -- jamb --.

Signed and Sealed this

Twenty-third Day of May, 2006

JON W. DUDAS
*Director of the United States Patent and Trademark Office*